US005391051A

United States Patent [19]

Sabatier et al.

[11] Patent Number: 5,391,051

[45] Date of Patent: Feb. 21, 1995

[54] UNSTACKER FOR UNSTACKING FLAT ITEMS, THE UNSTACKER INCLUDING REALIGNMENT APPARATUS

[75] Inventors: Louis Sabatier, Montelier; Franck Walpole, Paris; Olivier Roch, Valence, all of France

[73] Assignee: Compagnie Generale d'Automatisme CGA-HBS, Bretigny sur Orge, France

[21] Appl. No.: 126,300

[22] Filed: Sep. 24, 1993

[30] Foreign Application Priority Data

Sep. 25, 1992 [FR] France ..... 92 11468

[51] Int. Cl.[6] ..... B65H 3/12; B65H 5/08; B65G 59/02

[52] U.S. Cl. ..... 414/797.2; 271/11; 271/12; 271/96

[58] Field of Search ..... 271/11, 12, 94, 96; 414/797, 797.2

[56] References Cited

U.S. PATENT DOCUMENTS

| | | | |
|---|---|---|---|
| 3,730,514 | 5/1973 | Burkhardt | 271/96 |
| 4,030,723 | 6/1977 | Irvine et al. | 271/11 |
| 4,357,007 | 11/1982 | Mens Francsicus et al. . | |
| 4,451,028 | 5/1984 | Holmes et al. | 271/94 |
| 4,701,094 | 10/1987 | Courjaret et al. | 271/11 |
| 5,244,343 | 9/1993 | Lockert | 414/797 |
| 5,290,022 | 3/1994 | Sabatier et al. | 271/12 |

FOREIGN PATENT DOCUMENTS 1245390 7/1967 Netherlands .

*Primary Examiner*—Andres Kashnikow
*Assistant Examiner*—Christopher G. Trainor
*Attorney, Agent, or Firm*—Sughrue, Mion, Zinn, Macpeak & Seas

[57] ABSTRACT

An unstacking apparatus including a first suction nozzle (7) and a second suction nozzle (8) that are disposed on one side of an alignment plate (3), a perforated endless belt (6) continuously advancing past the suction nozzles and the free face of the first item in a stack of items, a passage forming an outlet between the alignment plate and the belt, at least one sensor (17, 18, 19) disposed on the other side of the alignment plate, and a microcomputer (10) for actuating one of the nozzles in an unstacking cycle. A microcomputer is organized so as to detect that a first item in the stack is backwardly misaligned by monitoring the operation of one of the suction nozzles during the unstacking cycle, and so as to trigger a realignment cycle in response to such detection, during which realignment cycle the nozzles are actuated alternately.

13 Claims, 4 Drawing Sheets

UNSTACKER FOR UNSTACKING FLAT ITEMS, THE UNSTACKER INCLUDING REALIGNMENT APPARATUS

BACKGROUND OF THE INVENTION

The invention relates to apparatus for unstacking flat items, such as mail items that may be closed or open. This type of apparatus is used in particular in machines for automatically sorting mail items or the like.

U.S. Pat. No. 4,357,007 discloses an apparatus for unstacking flat items that includes a first suction nozzle and a second suction nozzle disposed on one side of an alignment plate, a perforated endless belt advancing continuously past the suction nozzles and past the free face of the first item in a stack of items, a passage forming an outlet between the alignment plate and the belt, and a first sensor and a second sensor that are disposed on the other side of the alignment plate. The second suction nozzle is spaced apart from the first suction nozzle downstream in the advance direction of the endless belt, and the second sensor is spaced apart from the first sensor downstream in the advance direction of the belt. The second sensor causes either the first suction nozzle or the second suction nozzle to operate depending respectively on whether the first sensor detects an item or does not detect an item.

That known apparatus makes it possible to single items from a stack of items and to distribute them one by one towards the outlet even when some of the items in a stack of items standing on their edges and abutting against an alignment plate are misaligned.

A problem encountered in apparatus for unstacking items is that two consecutive items in a stack of items to be singled are not always disposed with their leading edges in contact with the alignment plate, thereby giving rise to malfunctions in the unstacking apparatus. For example, when a first item in the stack has its leading edge set back from the alignment plate and beyond the trailing edge of a suction nozzle, and when a second item has its leading edge in contact with the alignment plate, the second item and not the first item is taken first by the suction nozzle when said nozzle is actuated and said second item is then conveyed towards the outlet by the endless belt before the first item. If the first item in the stack is not displaced towards the alignment plate, said first item will never be unstacked.

In the above-mentioned document, first control means are provided for selectively actuating the suction nozzles in response to the signals supplied by the sensors. The control means operate as follows. If, at time $t=0$, the sensors detect the absence of an item at the outlet, the control means actuate the first suction nozzle until the first sensor detects the presence of the article, thereby causing the first suction nozzle to be deactivated, and the second suction nozzle to be actuated. The item retained against the endless belt by the second suction nozzle is displaced towards the outlet until the second sensor detects the presence of the article, thereby causing the second suction nozzle to be deactivated.

That known apparatus suffers from drawbacks. Firstly, the amount of misalignment that is acceptable between the leading edges of the items is equal to the distance between the trailing edge of the first suction nozzle and the surface of the alignment plate. But the maximum distance between the trailing edge of the first suction nozzle and the first sensor is equal to the size of the smallest item in the stack. Since the sensors are disposed on a different side of the alignment plate from the suction nozzles, the maximum acceptable misalignment is less than the size of the smallest item in the stack. Secondly, under normal operating conditions, i.e. when no article in the stack is set back out of alignment, the control means actuate the first suction nozzle and then the second suction nozzle simultaneously. As a result, the rate of unstacking is lower than the rate which would be obtained if the control means were to activate a single suction nozzle. An item that is referred to below as being "backwardly misaligned" is an item that has its leading edge set back from the alignment plate beyond the trailing edge of the second suction nozzle. The term "realignment" designates the action of bringing the leading edge of a misaligned item forward against the alignment plate once again.

SUMMARY OF THE INVENTION

An object of the invention is to remedy those drawbacks by providing in particular unstacking apparatus that accepts backward misalignment that is greater than the size of the smallest item in a stack of items.

To this end, the invention provides unstacking apparatus for unstacking flat items, in particular mail items, the apparatus comprising an alignment plate having an abutment surface against which a stack of flat items on edge abuts, an endless belt continuously advancing past the free face of the first item in the stack so as to convey the items from the stack towards an outlet, first gripping means disposed on the abutment surface side of the alignment plate so that when actuated they take the items from the stack and hold them against the endless belt, second gripping means disposed between the first gripping means and the alignment plate so that when actuated they take the items from the stack and hold them against the endless belt, at least one sensor disposed on that side of the alignment plate which is opposite from the abutment surface so as to supply a signal in response to the presence or the absence of an article being detected at the outlet, control means for selectively actuating the second gripping means in response to the signal supplied by the sensor so as to perform an unstacking cycle, said apparatus being characterized in that the control means are organized so as to detect that a first item in the stack is backwardly misaligned from said second gripping means by monitoring the operation of the second gripping means during the unstacking cycle, and so as to respond to backward misalignment being detected by performing a realignment cycle during which said control means selectively and successively actuate the first gripping means and the second griping means.

In this way, the maximum acceptable distance between the sensor and the trailing edge of the second gripping means is equal to the size of the smallest item in the stack. In addition, the maximum acceptable distance between the trailing edge of the first gripping means and the leading edge of the second gripping means is equal to the smallest size of an item in the Stack. Since the gripping means and the sensors are disposed on respective sides of the alignment plate, the maximum acceptable backward misalignment is equal to the distance between the trailing edge of the first gripping means, and the alignment plate. Therefore, this distance may be greater than the size of the smallest item in the stack. Moreover, the first gripping means are actuated only in the event that backward misalignment is detected by the control means, thereby guaranteeing an optimum unstacking rate when there are no backwardly misaligned items in the stack.

In a particular embodiment, the microcomputer controls a timer which is triggered at the same time as the second gripping means are actuated by the control means during the unstacking cycle, and which is stopped when said sensor detects the presence of an item, and the control means are organized so as to perform the realignment cycle if said timer has not been stopped before the end of a reference duration. The timer may be set for a plurality of reference durations so that it is possible to detect backwardly misaligned items that have different characteristics. Such a timer is easy to implement in the form of a program loaded in a microcomputer, and the control means may also consist of a program loaded in the microcomputer.

The unstacking apparatus also includes a suction sensor which monitors the suction in a vacuum tank connected to the gripping means which are constituted by suction nozzles. The suction sensor also supplies a backward misalignment detection signal to the control means when the detected suction is less than a reference suction.

The unstacking apparatus also includes a low-suction chamber disposed between the gripping means, the function of this chamber being to draw the first item in the stack close to the endless belt, thereby increasing the rate at which the items in the stack are unstacked.

A detailed description of an embodiment of the invention is given below with reference to the accompanying drawings, in which:

DESCRIPTION OF A PREFERRED EMBODIMENT

Figure 1A:
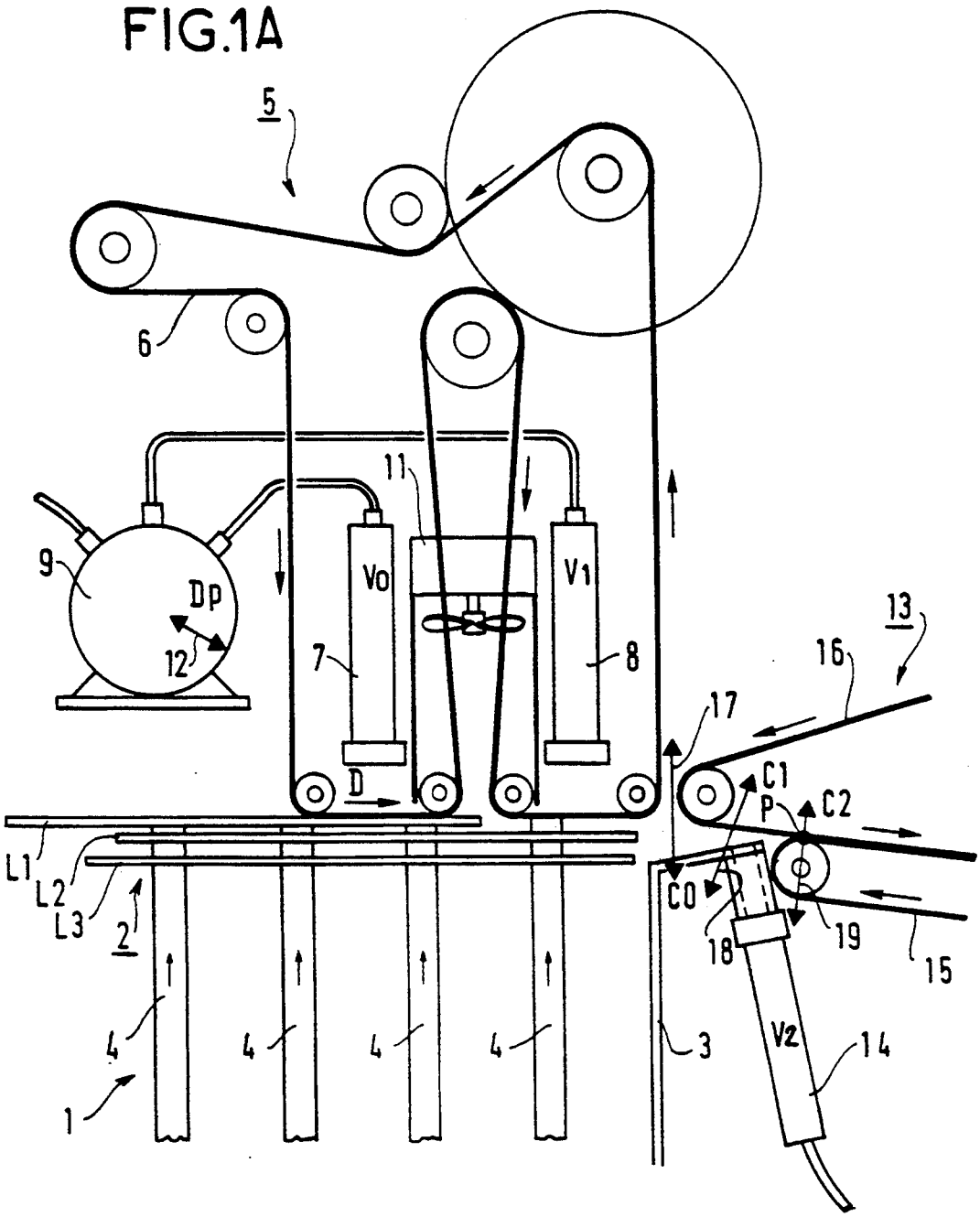
FIG. 1A is a diagrammatic plan view of the unstacking apparatus.
Figure 1B:
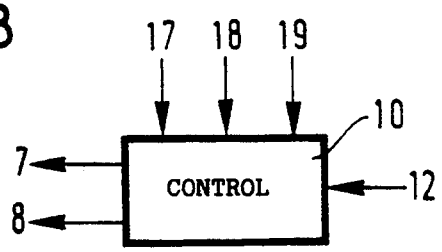
FIG. 1B is a block diagram of the control circuit of the apparatus.

With reference to FIGS. 1A and 1B, the apparatus includes an inlet stage 1 for receiving a stack of mail items 2 on edge and abutting against a "jogging" or alignment plate 3. The stack is brought against the alignment plate 3 via a feed-way that is either substantially horizontal or sloping and that is formed by conveyor belts 4. In FIG. 1A, three mail items are shown, referenced L1, L2, and L3. Item L1 is backwardly misaligned, with its leading edge not being in contact with the alignment plate 3.

The apparatus also includes an unstacking stage 5 disposed facing the front face of the first item L1 in the stack and situated on the same side of the alignment plate as that against which the stack of items bears. The unstacking stage includes a perforated endless belt 6 advancing continuously past the free face of the first item in the stack in a direction designated by arrow D. The belt is guided and driven by pulleys and it co-operates with the alignment plate 3 to delimit a mail-item outlet.

The unstacking stage also includes a first suction nozzle 7 and a second suction nozzle 8 that are mounted along the endless belt facing the top of the stack, with the endless belt advancing between the suction nozzles and the items in the stack 2. The suction nozzles 7, 8 have their outlets connected to a vacuum tank 9 via solenoid valves (not shown). The vacuum tank is connected to a vacuum pump (not shown) which continuously maintains a pressure in the tank that is about 300 mbars below atmospheric pressure. The suction nozzles are actuated selectively via their respective solenoid valves by a microcomputer 10 so that an item is taken from the stack and is held against the endless belt, thereby separating the items from the stack of items to be singled.

The unstacking stage 5 further includes a low-suction chamber 11 disposed between the two suction nozzles and acting continuously so as to keep the first item in the stack close to the endless belt or in contact therewith. As shown in FIG. 1A, the endless belt 6 follows a path which leaves a gap between the two nozzles 7, 8 so as to allow the low-suction chamber to act directly on the items in the stack.

A suction sensor 12 is provided inside the vacuum tank 9 so as to supply a signal to the microcomputer 10 when said suction sensor detects that the suction inside the vacuum tank is less than or greater than a reference value, e.g. equal to 250 mbars below atmospheric pressure.

The unstacking apparatus further includes a distribution stage 13 disposed on the opposite side of the alignment plate from the abutment surface against which the stack of mail items abuts. The distribution stage includes a suction nozzle 14 connected to the vacuum tank 9, which nozzle acts on the rear face of an unstacked item arriving at the outlet, and a transfer member for transferring singled items, which member is constituted by two endless belts 15, 16 that are guided and driven by pulleys, and that act by nipping the singled items. The purpose of nozzle 14 is to prevent two items from being taken at once. Sensors 17, 18, and 19 are provided in the distribution stage, which sensors supply detection signals to the microcomputer 10, the detection signals signalling detection of the presence or the absence of an item at the outlet of the unstacking stage. The sensors are constituted conventionally by light-emitting diodes and by photocells. Sensor 17 is placed immediately at the outlet of the unstacking stage between belt 6 and belt 16, and downstream from the alignment plate 3. Sensor 18 is placed downstream from sensor 17 in the advance direction of the belt (arrow referenced D), but preferably upstream from the nip point P. Sensor 19 is placed downstream from sensor 18 in the vicinity of the nip point between belts 15 and 16.

Figure 2:
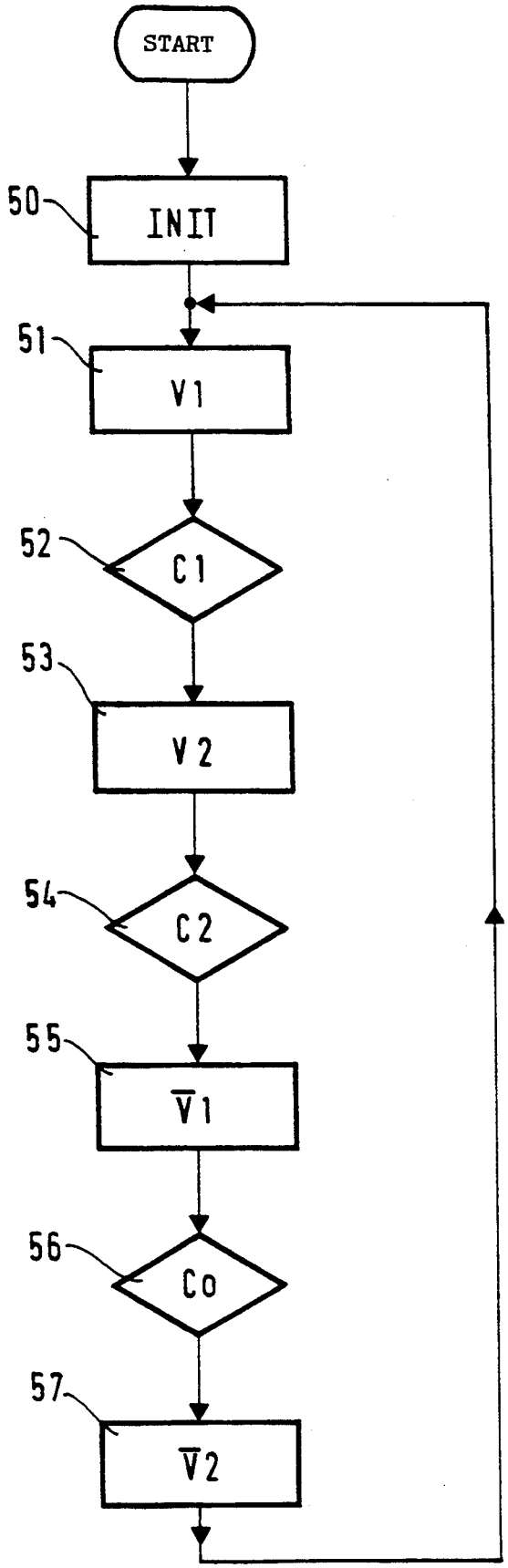
FIG. 2 is a flow chart showing an unstacking cycle.
Figure 3:
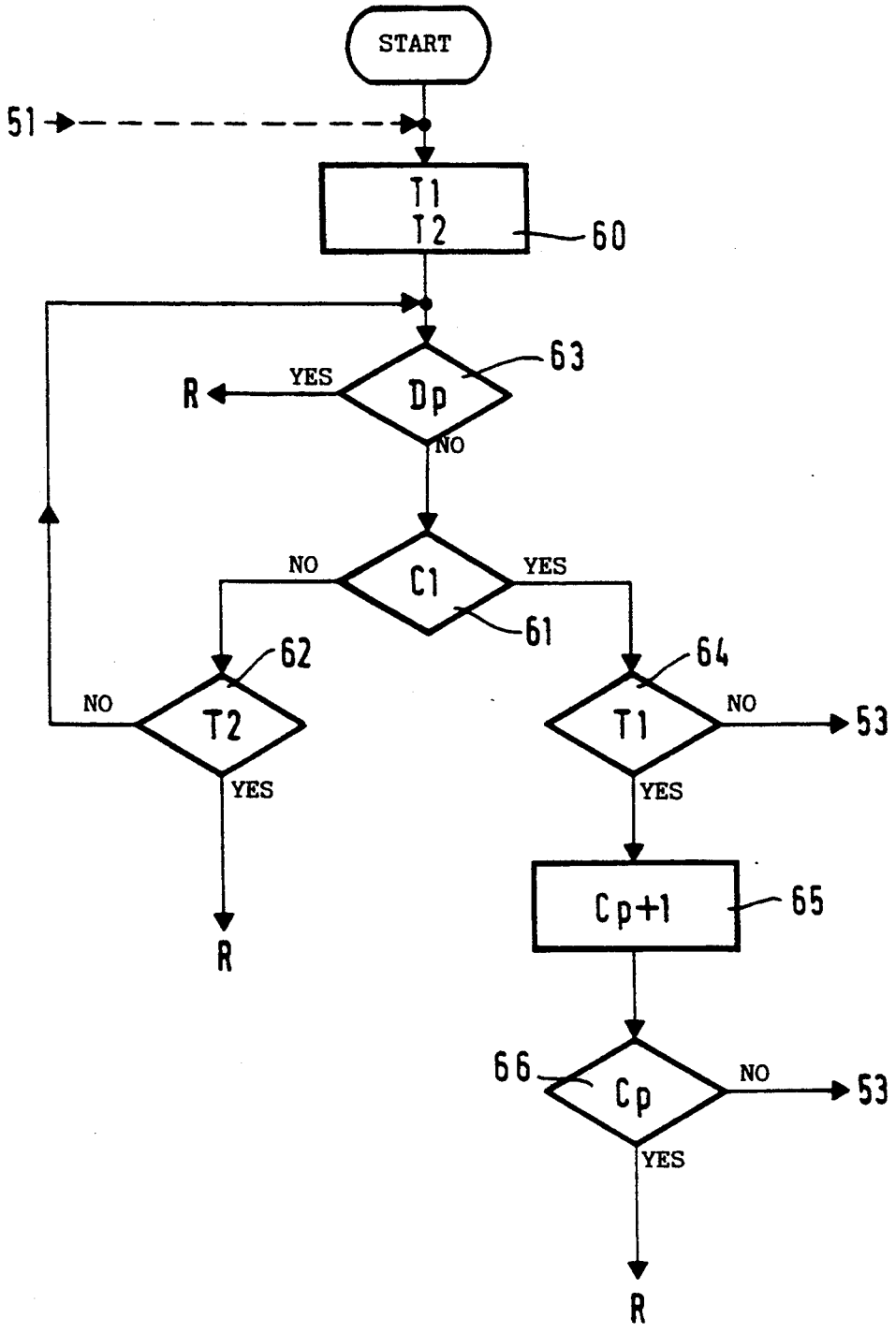
FIG. 3 is a flow chart showing a misalignment detection cycle.
Figure 4:
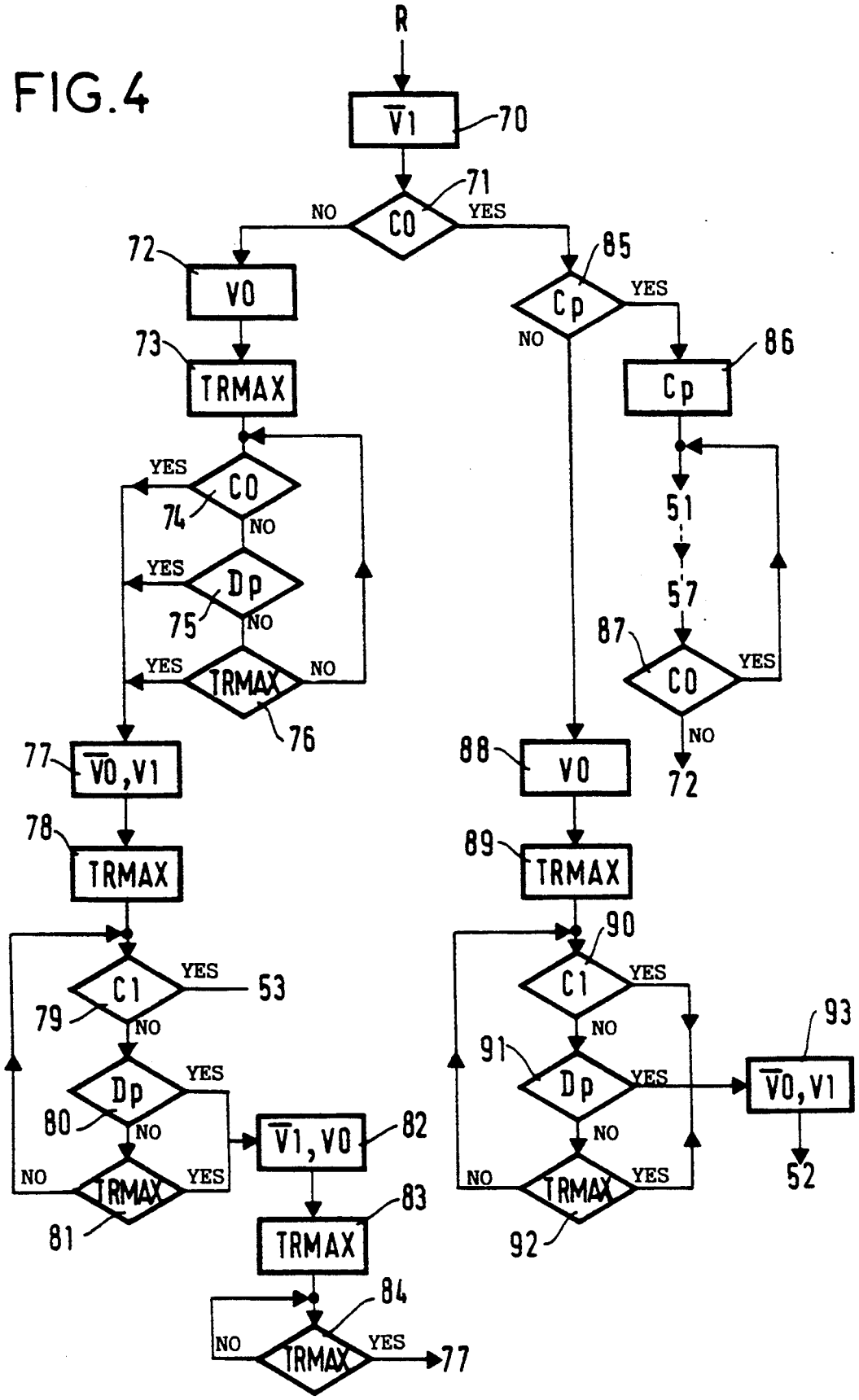
FIG. 4 is a flow chart showing a realignment cycle.

The operation of the unstacking apparatus is described below with reference to FIGS. 2 to 4.

UNSTACKING CYCLE (FIG. 2)

The cycle starts with an initialization step 50 in which the nozzles 7, 8, 14 are deactivated, the belt 6 and the rollers 20 are driven, and the low-suction chamber 11 is actuated. The microcomputer 10 actuates nozzle 8 (V1) at 51 so as to unstack an item from the stack. As soon as sensor 18 (C1) detects the presence of the item at 52, it sends a signal to the microcomputer 10 which actuates nozzle 14 (V2) at 53 after a delay enabling the item to reach the nip point. As soon as sensor 19 (C2) detects the presence of the item at 54, it sends a signal to the microcomputer 10 which deactivates nozzle V1 at 55, and as soon as sensor 17 (CO) detects the absence of the item at 56, it sends a signal to the microcomputer which deactivates nozzle V2 at 57. The unstacking cycle starts again at 51 for a new item, after a delay enabling the desired separation to be obtained between each singled item that is carried away by belts 15 and 16.

Clearly, given the position of the position sensor C2, the maximum distance between the trailing edge of nozzle V1 and sensor C2 is equal to the size of the smallest item that the unstacker can handle.

MISALIGNMENT DETECTION CYCLE (FIG. 3)

This cycle starts when nozzle V1 is actuated in step 51. Two alternative detection Steps are performed which start with a timer (clock of the microcomputer) being set for two durations T1 and T2, duration T1 being equal to 50 ms, for example, and duration T2 being equal to 150 ms, for example.

The cycle may consist in monitoring the time lapse between the instant at which nozzle V1 is actuated and the instant at which sensor Cl detects an item that is being unstacked. If an item such as L1 is misaligned, it shuts off the continuous low-suction chamber 11 to a greater or lesser extent, and prevents the second item L2 in the stack from being drawn against the belt 6.

If, before the end of duration T1 at 64, sensor C1 detects the presence of the item at 61, there is no misaligned item, and the microcomputer continues the detection cycle with the unstacking cycle at 53.

If sensor C1 detects the presence of the item at 61 after the end of duration T1 at 64, the microcomputer increments a counter at 65. The cycle continues at 53 so long as the value of the counter has not reached, at 66, a predetermined count value, e.g. 3. If the counter has reached said count value at 66, the cycle is continued with a realignment cycle R.

This detection step applies to misaligned items that are thin and/or that partially shut off chamber 11.

If, after the end of duration T2 at 62, sensor C1 has still not detected the presence of the item at 61, the cycle continues with a realignment cycle R.

This detection step applies to misaligned items that are thick and/or that shut off chamber 11 entirely.

The misalignment detection Cycle may also consist in monitoring the suction in the vacuum tank while nozzle V1 is being actuated.

If, during one of durations T1 and T2 after 60, the suction sensor 12 detects, at 63, that the suction in the vacuum tank is less than a reference suction, the misalignment detection cycle is continued with a realignment cycle R, and otherwise the cycle continues at 61.

When the solenoid valve controlling nozzle V1 is opened by the microcomputer 10, the vacuum tank fills with air until the item L1 is drawn against the belt 6. In this short lapse of time there is a temporary decrease in the suction in the vacuum tank. If a thick item is backwardly misaligned, it interferes sufficiently with the operation of nozzle V1 to cause a decrease in the suction in the vacuum tank that is detected by sensor 12. Monitoring the suction offers the advantage of enabling backward misalignment to be detected quickly, and the items to be unstacked in order.

REALIGNMENT CYCLE (FIG. 4)

The realignment cycle starts with nozzle V1 being deactivated at 70.

Alternative realignment steps are performed as a result of sensor CO detecting the presence or the absence of an item at 71.

CASE 1

If sensor CO detects the absence of an item at 71, the microcomputer actuates nozzle V0 at 72, and triggers the timer at 73 for a duration TRMAX that is equal, for example, to 100 ms. The microcomputer 10 then deactivates nozzle V0 and simultaneously activates nozzle V1 at 77 if sensor C0 detects the presence of an item at 74, or if the suction sensor 12 detects a loss of suction at 75 or if the duration TRMAX has elapsed at 76. At 78, the microcomputer triggers the timer again for a duration TRMAX that is equal to 150 ms, for example. If sensor C1 detects the presence of an item at 79 before the end of duration TRMAX at 81, then the microcomputer continues the unstacking cycle at 53. If sensor C1 does not detect the presence of an item at 79 before the end of duration TRMAX, or if sensor 12 detects a loss of suction at 80, then the microcomputer deactivates nozzle V1 and simultaneously actuates nozzle V0 at 82, and then triggers the timer at 83 for a new duration TRMAX, e.g. equal to 300 ms. At the end of duration TRMAX at 84, the microcomputer continues the cycle at 77 as above. If, once again, sensor C1 does not detect an item at 79, the microcomputer triggers the timer at 83 for a duration TRMAX of 500 ms, and then continues the cycle at 77 as above. If, once again, sensor C1 does not detect an item at 79, the microcomputer triggers the timer at 83 for a duration TRMAX of 500 ms, and then continues the cycle at 77 as above. Finally, if sensor C1 still does not detect an item at 79, the unstacker is stopped.

CASE 2

If sensor C0 detects the presence of an item at 71, a first letter L1 is backwardly misaligned and a second letter L2 is forwardly misaligned. The microcomputer then checks the value on the counter at 85. If the value of the counter is equal to the predetermined count value (3 in this case), the microcomputer initializes the counter at 86, and then continues the cycle with an unstacking cycle starting at 51 and finishing at 57. If, at the end of the unstacking cycle, sensor CO detects the presence of an item at 87, the unstacking cycle is started again at 51 and is continued until 57. As soon as sensor CO detects the absence of an item at 87, the realignment cycle continues at 72. If the value on the counter is not equal to the predetermined count value at 85, the microcomputer actuates nozzle V0 at 88 and triggers the timer at 89 for a duration TRMAX that is equal to 150 ms, for example. If sensor C1 detects the presence of an item at 90, or if sensor 12 detects a loss of suction at 91, or if the duration TRMAX has elapsed at 92, the microcomputer deactivates nozzle V0 and actuates nozzle V1 at 93. The realignment cycle then continues with an unstacking cycle at 52.

Clearly, the distance between the trailing edge of nozzle V0 and sensor C0 may be greater than the size of the smallest item to be handled. But the maximum distance between the trailing edge of nozzle V0 and the leading edge of nozzle V1 is equal to the size of the smallest item that can be handled. As a result, the maximum acceptable backward misalignment is equal to the distance between the leading edge of nozzle V0 and the alignment plate. Said acceptable backwards misalignment may vary depending on how far the leading edge of nozzle V1 is from the alignment plate.

The unstacker of the invention is particularly well suited to mail items that have widely different weights and sizes. The unstacker may be able to accept backward misalignment of as much as 150 mm when the size of the smallest item is 125 mm.

Naturally, the invention is not limited to the above-described embodiment, and other variants may be provided without going beyond the ambit of the invention.

We claim:

1. Unstacking apparatus for unstacking flat items, in particular mail items, the apparatus comprising an alignment plate (3) having an abutment surface against which a stack (2) of flat items (L1, L2, L3) on edge abuts, an endless belt (6) continuously advancing past the free face of the first item in the stack so as to convey the items from the stack towards an outlet, first gripping means (7) disposed on the abutment surface side of the alignment plate so that when actuated said first gripping means (7) take the items from the stack and hold them against the endless belt, second gripping means (8) disposed between the first gripping means and the alignment plate so that when actuated said second gripper means (8) take the items from the stack and hold them against the endless belt, at least one sensor (18) disposed on that side of the alignment plate which is opposite from the abutment surface so as to supply a signal in response to the presence or the absence of an item being detected at the outlet, control means (10) for selectively actuating the second gripping means in response to the signal supplied by said one sensor (18) so as to perform an unstacking cycle, said apparatus being characterized in that the control means are organized so as to detect that the first item in the stack is backwardly misaligned from said second gripping means by monitoring the operation of the second gripping means (8) during the unstacking cycle, and so as to respond only to backward misalignment being detected by performing a realignment cycle during which said control means both selectively and successively actuate the first gripping means (7) and the second gripping means (8).

2. Unstacking apparatus for unstacking flat items, in particular mail items, the apparatus comprising an alignment plate (3) having an abutment surface against which a stack (2) of flat items (L1, L2, L3) on edge abuts, an endless belt (6) continuously advancing past the free face of the first item in the stack so as to convey the items from the stack towards an outlet, first gripping means (7) disposed on the abutment surface side of the alignment plate so that when actuated said first gripping means (7) take the items from the stack and hold them against the endless belt, second gripping means (8) disposed between the first gripping means and the alignment plate so that when actuated said second gripping means (8) take the items from the stack and hold them against the endless belt, at least one sensor (18) disposed on that side of the alignment plate which is opposite from the abutment surface so as to supply a signal in response to the presence or the absence of an item being detected at the outlet, control means (10) for selectively actuating the second gripping means in response to the signal supplied by said one sensor (18) so as to perform an unstacking cycle, said apparatus being characterized in that the control means are organized so as to detect that the first item in the stack is backwardly misaligned from said second gripping means by monitoring the operation of the second gripping means (8) during the unstacking cycle, and so as to respond to backward misalignment being detected by performing a realignment cycle during which said control means selectively and successively actuate the first gripping means (7) and the second gripping means (8); in which apparatus the control means control a timer which is triggered at the same time as the second gripping means (8) are actuated during the unstacking cycle, and which is stopped when said one sensor (18) detects the presence of an item, and in which apparatus the control means are organized so as to perform the realignment cycle if said timer has not been stopped before the end of a reference duration.

3. Apparatus according to claim 2, in which the control means are organized to perform a misalignment detection cycle starting at time $t=0$, which is defined as being the time at which the control means (10) actuate the second gripping means (8) for an unstacking cycle when said one sensor (18) detects the absence of an item, the misalignment detection cycle comprising the following alternative steps:

a) if, after said reference duration has a first duration T1 that is shorter than a second duration T2, said one sensor detects the presence of an item, the control means increment a counter and continue the unstacking cycle, and if said counter reaches a predetermined count value after a plurality of successive unstacking cycles, then the control means perform the realignment cycle; or b) if, after the second duration T2, the sensor has not detected the presence of an item, the control means perform the realignment cycle.

4. Apparatus according to claim 3, including an upstream sensor (17) disposed on said side of the alignment plate which is opposite from the abutment surface, said one sensor (18) being spaced apart from the upstream sensor (17) downstream in the advance direction of the endless belt, so as to supply signals in response to the presence or the absence of an item being detected at the outlet, and in which apparatus the control means (10) are organized to perform the realignment cycle staffing at time $t'=0$, which is defined as being the time at which the control means deactivate the second gripping means, the realignment cycle comprising the following alternative steps:

a) if said upstream sensor (17) detects the absence of an item, the control means (10) actuate the first gripping means (7) so as to take at least one item from the stack and so as to hold it against the endless belt until:

said upstream sensor (17) detects the presence of an item; or a waiting duration TRMAX has elapsed;

whereafter the control means (10) deactivate the first gripping means (7) and simultaneously actuate the second gripping means (8); or b) if said upstream sensor (17) detects the presence of an item, the control means (10) actuate the first gripping means (7) until:

said one sensor (18) detects the presence of an item; or a waiting duration TRMAX has elapsed;

whereafter the control means (10) deactivate the first gripping means (7) and simultaneously actuate the second gripping means (8).

5. Apparatus according to claim 4, in which the control means are organized to continue step a) of the realignment cycle with an unstacking cycle if said one sensor detects the presence of an item before the end of said waiting duration TRMAX that starts at the time at which the control means actuate the second gripping means, and otherwise with at least one new realignment cycle.

6. Apparatus according to claim 4, in which the control means are organized to perform an unstacking cycle when the presence of an item is detected by said upstream sensor and if the counter has reached said count value, and so long as said upstream sensor detects the presence of an item, the control means then performing a realignment cycle.

7. Apparatus according to claim 4, in which the control means are organized to continue step b) of the realignment cycle with an unstacking cycle.

8. Apparatus according to claim 3, in which said first and second gripping means respectively comprise a first suction nozzle (7) and a second suction nozzle (8) that is spaced apart from the first suction nozzle downstream in the advance direction of the endless belt, said suction nozzles being connected to a vacuum tank (9), and being actuated selectively by the control means (10) so as to take the items from the stack and so as to hold them against the endless belt, said apparatus further including a suction sensor (12) disposed inside the vacuum tank so as to supply a signal in response to the suction inside the vacuum tank being detected to be less than or greater than a reference suction, and in which apparatus the misalignment detection cycle further includes an alternative step c) in which the control means are organized to perform a misalignment cycle if the suction sensor (12) detects that the suction in the vacuum tank is less than the reference suction.

9. Apparatus according to claim 8, in which, in step a) of the misalignment cycle, the control means actuate the first suction nozzle so as to take at least one item from the stack and so as to hold it against the endless belt until the suction sensor detects that the suction in the vacuum tank is less than the reference suction.

10. Apparatus according to claim 8, in which, in step b) of the misalignment cycle, the control means actuate the first suction nozzle so as to take at least one item from the stack and so as to hold it against the endless belt until the suction sensor detects that the suction in the vacuum tank is less than the reference suction.

11. Apparatus according to claims 3, 4, 5 or 8, in which the first duration T1 is equal to 50 ms and the second duration T2 is equal to 150 ms.

12. Apparatus according to claim 11, in which the waiting duration TRMAX varies in the range 100 ms to 500 ms.

13. Apparatus according to claim 8, said apparatus further including a low-suction chamber (11) disposed between the two suction nozzles.

* * * * *